US006866337B1

(12) United States Patent
Lash

(10) Patent No.: US 6,866,337 B1
(45) Date of Patent: Mar. 15, 2005

(54) PROTECTIVE COVER FOR A WHEELCHAIR

(76) Inventor: Wendy V. Lash, 12513 W. Woodland Ave., Avondale, AZ (US) 85323

( * ) Notice: Subject to any disclaimer, the term of this patent is extended or adjusted under 35 U.S.C. 154(b) by 0 days.

(21) Appl. No.: 10/703,227

(22) Filed: Nov. 5, 2003

(51) Int. Cl.[7] ..... A47C 31/00

(52) U.S. Cl. ..... 297/219.1; 297/188.2; 297/228.1

(58) Field of Search ..... 297/218.1, 218.2, 297/218.3, 218.5, 219.1, 188.01, 188.04, 297/188.06, 188.07, 188.08, 188.12, 188.2, 297/228.1, 229, DIG. 6; 5/653, 652, 645, 5/633

(56) References Cited

U.S. PATENT DOCUMENTS

| | | | | |
|---|---|---|---|---|
| 1,024,526 | A | | 4/1912 | Schweikert |
| 1,659,405 | A | | 2/1928 | Love |
| 2,667,915 | A | | 2/1954 | Pfeffer et al. |
| 2,922,466 | A | | 1/1960 | Marston |
| 3,051,966 | A | | 9/1962 | Ness |
| 3,278,226 | A | | 10/1966 | Magnusson |
| 3,513,492 | A | | 5/1970 | Phillips |
| 4,232,898 | A | | 11/1980 | Bodrero |
| 4,242,086 | A | | 12/1980 | Jorg |
| 4,273,380 | A | | 6/1981 | Silvestri |
| 4,277,859 | A | | 7/1981 | Seaman |
| 4,577,903 | A | | 3/1986 | Wells |
| 4,597,605 | A | * | 7/1986 | Gilbert ..... 297/228.1 |
| 4,656,670 | A | | 4/1987 | Schluter |
| D293,868 | S | | 1/1988 | Paletta et al. |
| 4,725,094 | A | | 2/1988 | Greer |
| 4,824,168 | A | | 4/1989 | Makoski |
| 4,843,662 | A | * | 7/1989 | Handelman ..... 5/653 |
| 4,844,539 | A | | 7/1989 | Selbert |
| 4,854,637 | A | * | 8/1989 | McCree ..... 297/188.2 |
| 4,925,241 | A | | 5/1990 | Geraci |
| 5,005,901 | A | * | 4/1991 | Hinde ..... 297/229 |
| 5,106,152 | A | | 4/1992 | Ward et al. |
| 5,121,938 | A | | 6/1992 | Gross et al. |
| D329,957 | A | * | 10/1992 | Hartnett ..... D6/601 |
| D335,235 | S | | 5/1993 | Hildreth |
| 5,356,059 | A | | 10/1994 | Yanez et al. |
| D357,609 | S | | 4/1995 | Webb et al. |
| 5,573,288 | A | | 11/1996 | Raffensperger |
| D387,940 | S | | 12/1997 | Bruner et al. |
| D396,983 | S | | 8/1998 | Taylor |

(Continued)

*Primary Examiner*—Peter R. Brown
*Assistant Examiner*—Stephen Vu
(74) *Attorney, Agent, or Firm*—Charlene R. Jacobsen; Lowell W. Gresham; Meschkow & Gresham, P.L.C.

(57) ABSTRACT

A protective cover (20) for a wheelchair (60) includes a first cover section (22) and a second cover section (24). The first and second cover sections (22, 24) form a contiguous unit having a first surface (34) and a second surface (36). The protective cover (20) wraps around either a seat (64) or back (66) of the wheelchair (60) so that the first and second cover sections (22, 24) reside on opposite sides of the seat (64) or the back (66). Fastening elements (38, 42) detachably couple a fourth edge (32) of the second cover section (24) with a first edge (26) of a first cover section (22) to form a closed loop around the seat (64) or the back (66). The protective cover (20) may optionally include cushions (52) for occupant comfort, and storage pockets (44) for occupant convenience.

15 Claims, 3 Drawing Sheets

U.S. PATENT DOCUMENTS

| | | | |
|---|---|---|---|
| D396,984 | S | 8/1998 | Harvey et al. |
| 5,806,925 | A | 9/1998 | Hanley |
| 5,887,942 | A | 3/1999 | Allegro, Jr. |
| 5,927,800 | A | 7/1999 | Stallworth |
| 6,079,778 | A | 6/2000 | Lindberg |
| 6,312,051 | B1 | 11/2001 | Adams |
| D465,959 | A1 * | 11/2002 | Cameron ..... D6/611 |
| 6,520,639 | B2 | 2/2003 | Avner |
| D472,095 | S | 3/2003 | Smith et al. |
| 2002/0074839 | A1 | 6/2002 | Mahn |

* cited by examiner

PROTECTIVE COVER FOR A WHEELCHAIR

TECHNICAL FIELD OF THE INVENTION

The present invention relates to the field of wheelchairs. More specifically, the present invention relates to a protective cover for improving wheelchair comfort and appearance.

BACKGROUND OF THE INVENTION

Hospitals, nursing homes, and the like own large numbers of wheelchairs for use by many patients and clients. In addition, individuals whose physical condition calls for it also own wheelchairs for their personal use. These people depend on the same wheelchair over prolonged periods of weeks, months, or years.

Wheelchairs that are used by multiple individuals, such as those which are used in a nursing home or hospital, can present problems associated with cleanliness. In particular, the transmission of disease causing microorganisms can be exacerbated through the use of unsanitary medical care devices, such as wheelchairs, used by multiple individuals. This situation is highly undesirable among the ill and elderly population whose immune systems may already be compromised. Consequently, wheelchairs should be thoroughly cleaned and sanitized between uses by various individuals. Unfortunately, in an institutional setting, such as in a hospital or nursing home, it is not typically feasible to thoroughly clean a wheelchair between each and every use.

In addition to microorganisms, spills from food, medication, liquids, or other types of materials should preferably be cleaned from wheelchair surfaces almost as soon as they occur to prevent patient discomfort, staining, and so forth. Moreover, many patients suffer from incontinence, and this, too, leads to the frequent need to clean wheelchair surfaces. Indeed, even a wheelchair that is owned and used by a single individual must be periodically cleaned to remove many of the same contaminants discussed above.

In addition to problems associated with cleanliness and sanitation, patient comfort is another problem associated with wheelchairs. Wheelchair occupants may sit in substantially the same position for extended periods of time. This often results in the absorption of perspiration by the occupant's garments which are pressed between the occupant and the wheelchair seat and back. The moisture absorbed by the garments stays in contact with both the skin and the wheelchair, which can cause skin irritation, damage to the occupant's clothing, and/or damage to the wheelchair.

In addition to the problems discussed above, most wheelchairs lack in aesthetics. For example, a wheelchair seat and back are generally formed from a vinyl, heavy fabric, or leather material. These materials are typically a solid color, such as brown, black, blue, or grey. For those individuals who are required to utilize wheelchairs, the brown, black, blue, or grey appearance of the wheelchair can seem quite cheerless. Even those individuals who own their own chairs with customized upholstery can grow weary of the non-changing appearance of their wheelchair.

It is known that color can impact mood, appetite, and energy level. Indeed, years of color response research have shown that certain colors elicit specific, and often strong, responses. For example, particular colors, such as blues and greens, can calm, promote mental balance and physical well being, and encourage rest and solitude. Other colors, such as red, orange, and yellow, inspire vitality, courage, happiness, passion, and so forth. Often individuals will wear a particular color of clothing in an attempt to affect their emotions (for example, cheer themselves up) or to reflect their current emotional state. As an extension to wearing particular colored clothing to affect or reflect mood, it is desirable to be able to readily change the color of an occupant's wheelchair to effect or reflect mood, and/or to complement the individual's clothing.

Some prior art slip covers for wheel chairs have attempted to solve some of the aforementioned problems. Some covers are formed as a one-piece unit that covers both the seat and back of the chair. A problem associated with this type of cover is lack of universal fit with a multitude of wheelchair sizes. In addition, the entire cover must be removed and replaced if either the seat portion or the back portion of the cover becomes soiled. Yet another problem is the complex chair cover pattern, many fasteners, and/or the use of elastic (similar to a fitted sheet) for attaching the cover to the chair. Complexity typically leads to higher costs, thereby rendering such covers cost-prohibitive, especially in the instance when an individual wishes to own multiple covers.

In addition, some of these covers require the retrofit of fasteners onto the wheelchair that mate with corresponding fasteners on the cover. One such cover calls for the placement of hook and loop type fasteners on the seat of the wheelchair. It is highly undesirable to add fasteners to an existing wheelchair, due to potential damage to the wheelchair. Indeed, an individual would be prohibited from adding such fasteners to a rented wheelchair. In addition, if a cover is not utilized, exposed fasteners (such as the hook and loop fasteners on the wheelchair) may come into contact with the wheelchair occupant. This can lead to occupant discomfort, skin irritation, and/or damage to clothing.

Thus, what is needed is a protective cover for maintaining a wheelchair at an appropriate level of sanitation and cleanliness, while providing comfort to the individual. In addition, what is needed is a protective cover that is simple to use, and is an economical way to individualize or cosmetically enhance the appearance of a wheelchair.

SUMMARY OF THE INVENTION

Accordingly, it is an advantage of the present invention that a protective cover for a chair is provided.

It is another advantage of the present invention that a protective cover is provided that is a simple and economical way to establish and maintain clean and sanitary conditions for the wheelchair occupant.

Another advantage of the present invention is that the protective cover is individually installed and removed from either the back or the seat of the chair.

Yet another advantage of the present invention is that the protective cover can be readily and cost effectively changed out to reflect the wheelchair occupant's aesthetic needs and desires.

The above and other advantages of the present invention are carried out in one form by a cover for a chair. The cover includes a first cover section having a first edge and a second edge opposing the first edge, and a second cover section having a third edge and a fourth edge opposing the third edge, the third edge being conjoined with the first edge. The cover further includes means for detachably coupling the second cover section proximate the fourth edge with the first cover section proximate the first edge.

The above and other advantages of the present invention are carried out in another form by a protective cover for a wheelchair, the wheelchair including a seat and a back. The protective cover includes a first cover section having a first edge and a second edge opposing the first edge. The first cover section is configured to reside on a user-facing side of one of the seat and the back of the wheelchair. A second cover section has a third edge and a fourth edge opposing the third edge, the third edge being conjoined with the first edge. The second cover section is configured to reside on a second side of the one of the seat and the back opposite from the user-facing side. A storage pocket is coupled to the second cover section. In addition, the protective cover includes means for detachably coupling the second cover section proximate the fourth edge with the first cover section proximate the first edge to form a closed loop around the one of the seat and the back.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 2:
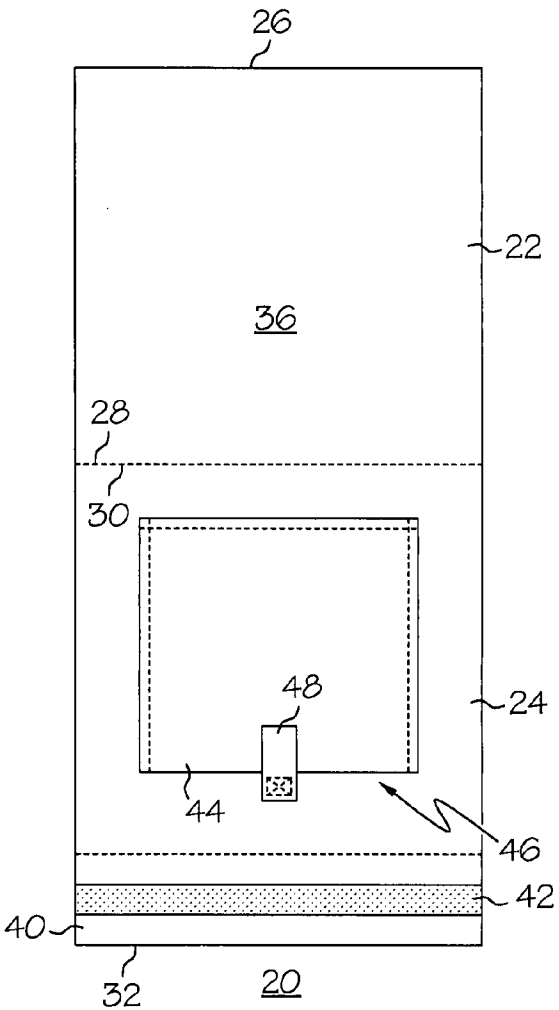
FIG. 2 shows a bottom view of the protective cover of FIG. 1.
Figure 1:
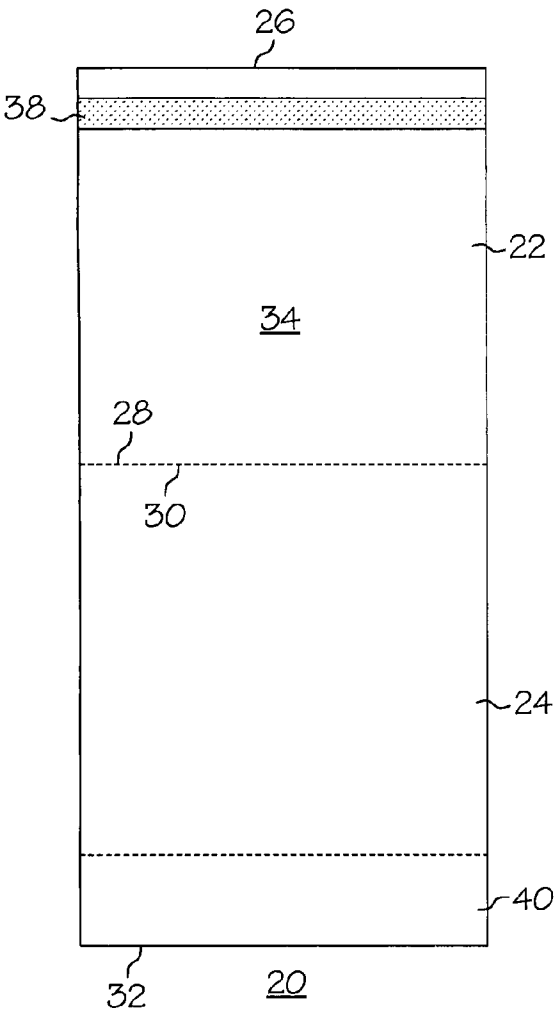
FIG. 1 shows a top view of a protective cover in accordance with a preferred embodiment of the present invention.

Referring to FIGS. 1-2, FIG. 1 shows a top view of a protective cover 20 in accordance with a preferred embodiment of the present invention, and FIG. 2 shows a bottom view of protective cover 20. That is, FIGS. 1 and 2 illustrate opposing sides of protective cover 20. Protective cover 20 is particularly suited for covering and protecting either a back or seat of a wheelchair. Furthermore, two units may be optionally utilized to cover and protect both the back and the seat of the wheelchair. Although the present invention is described in terms of its use with a wheelchair, it will become readily apparent that protective cover 20 may be utilized to cover many chairs that have a back and a seat separated by a gap.

Protective cover 20 includes a first cover section 22 and a second cover section 24. First cover section 22 has a first edge 26 and a second edge 28 opposing first edge 26. Similarly, second cover section 24 has a third edge 30 and a fourth edge 32 opposing third edge 30. Third edge 30 is conjoined with second edge 28. As such, first and second cover sections 22 and 24, respectively, form a contiguous, generally rectangular, unit having a first surface 34 and a second surface 36.

Protective cover 20 may be manufactured from a variety of materials that are preferably machine washable, fluid and stain resistant, draw perspiration moisture away from the wheelchair occupant, and are durable. In addition, materials may be selected that are colorful, have specific patterns, and/or are decorative in appearance. Some exemplary materials include cotton/polyester novelty prints, neoprene, olefin fiber (such as, Herculon), synthetic suede, and so forth.

Protective cover 20 further includes means for detachably coupling second cover section 24 with first cover section 22. In particular, a first coupler 38, in the form of loop fastener, is positioned on first surface 34 of first cover section 22. Second cover section 24 includes a flap portion 40 along fourth edge 32. A second coupler 42, in the form of a mating hook fastener, is positioned on second surface 36 of second cover section 24, along flap portion 40. In operation, flap portion 40 is folded to enable coupling of second coupler 42 with first coupler 38. Thus, first and second couplers 38 and 42, respectively, couple second cover section 24, proximate fourth edge 32, with first cover section 22, proximate first edge 26.

First and second couplers 38 and 42, respectively, are shown as being positioned across a width of protective cover 20. However, in an alternative embodiment, first and second couplers 38 and 42 may take the form of multiple, short strips that are positioned at fourth edge 32 and aligned with the length of protective cover. In that arrangement, protective cover 20 can be adjusted to fit varying depths of a chair seat and varying heights of the back of a chair. In a preferred embodiment, first and second couplers 38 and 42 are conventional hook and loop fasteners. However, those skilled in the art will recognize that other fasteners may be employed, such as snaps, clasps, buttons, and the like.

A storage pocket 44 is coupled to second surface 36 of second cover section 24. An opening 46 of storage pocket 44 faces fourth edge 32 of second cover section 24. Closure means, in the form of a tab 48, is configured for closing opening 46. Tab 48 may include hook fastener which couples with a corresponding loop fastener 50 (shown in FIG. 3) on storage pocket 44. Those skilled in the art will recognize that other fasteners may alternatively be employed, such as snaps, clasps, buttons, and the like.

Figure 3:
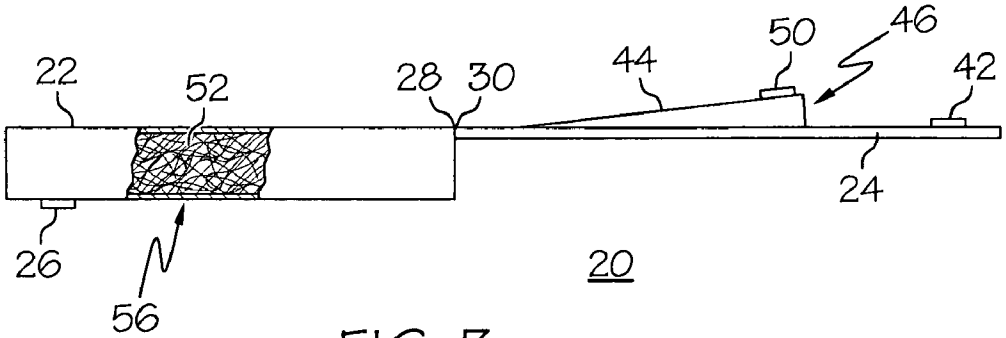
FIG. 3 shows a side view of the protective cover.
Figure 4:
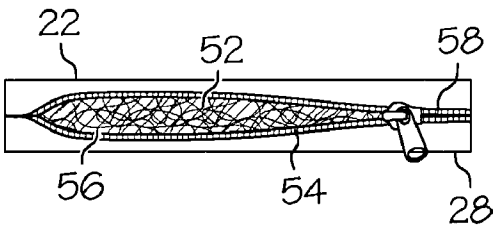
FIG. 4 shows an edge view of the protective cover.

Referring to FIGS. 3-4, FIG. 3 shows a side view of protective cover 20, and FIG. 4 shows an edge view of protective cover 20. First cover section 22 is configured for placement on a user-facing side of a seat or a back of a wheelchair. In order to enhance the comfort of protective cover 20, first cover section 22 further includes a cushion 52. Cushion 52 may be formed from a variety of materials that are preferably machine washable, durable, flame retardant, mildew resistant, and non-allergenic. Some exemplary materials include compressed polyester, polyester fiber fill, memory foam, and so forth.

In an exemplary embodiment, first cover section 22 includes an opening 54 located at the junction of second edge 28 of first cover section 22 with third edge 30 of second cover section 24. A closure element, such as a zipper 58, is utilized for closing opening 54. Opening 54 enables access to an interior cavity 56 of first cover section 22 for accommodating placement of cushion 52. That is, zipper 58 is opened, and cushion 52 may be installed into or removed from interior 56 through opening 54. Although zipper 58 is utilized herein, those skilled in the art will recognize that other closure elements may alternatively be employed, such as snaps, clasps, hook and loop fasteners, buttons, and the like.

In one embodiment, cushion 52 and protective cover 20 may be provided as a set. A user can readily remove cushion 52 from protective cover 20 prior to washing protective cover 20, if protective cover 20 becomes soiled. Alternatively, protective cover 20 and cushion 52 may be provided separately. As such, a wheelchair occupant who owns several protective covers 20, can own a single cushion 52 and easily transfer that cushion 52 between the multiple protective covers 20. Such an approach is more economical than having multiple cushions 52, and more storage efficient than attempting to store the multiple cushions 52.

Figure 5:
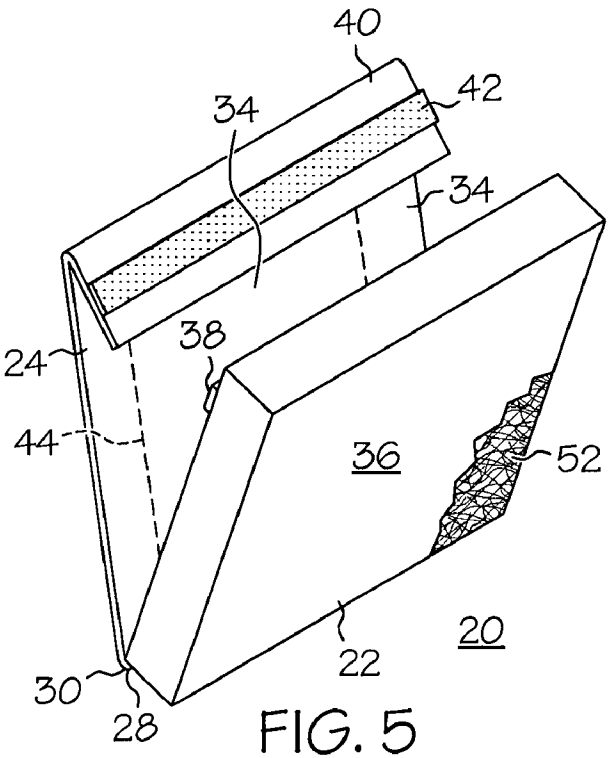
FIG. 5 shows a perspective view of the protective cover of FIG. 1.

FIG. 5 shows a perspective view of protective cover 20. Protective cover 20 is folded at second and third conjoined edges 28 and 20, respectively. In addition, flap portion 40 is folded so that first coupler 38, positioned on first surface 34, couples with second coupler 42 positioned on second surface 36 along flap portion 40. Consequently, a closed loop is formed with first surface 34 defining an interior of the closed loop. A cutaway reveals cushion 52 within first cover section 22, and storage pocket 44 is shown in ghost form on second cover section 24. When first and second couplers 38 and 42, respectively, are engaged, they are hidden from view for an aesthetically pleasing appearance. In addition, the hidden configuration of first and second couplers 38 and 42 largely prevents them from snagging on clothing, parcels, and so forth.

Figure 7:
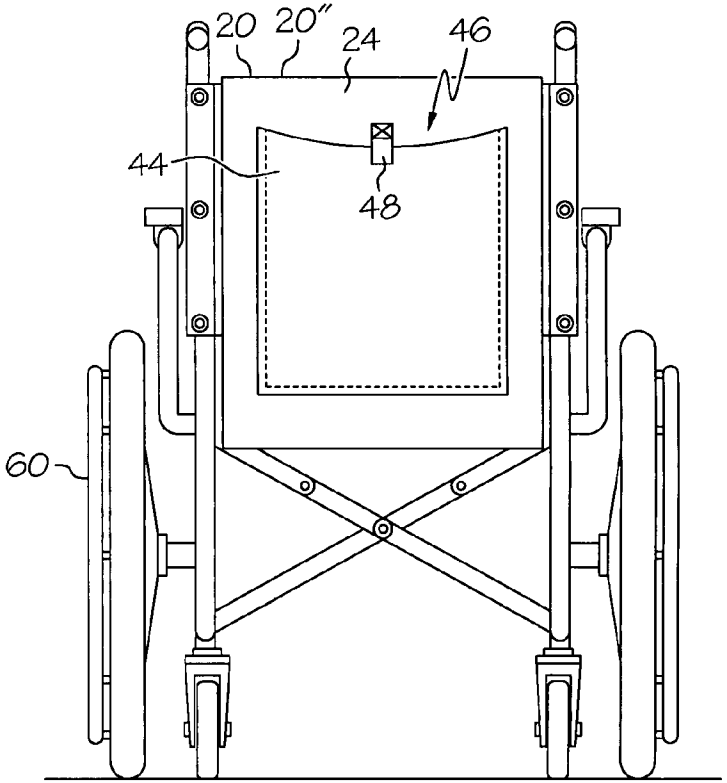
FIG. 7 shows a rear view of the wheelchair with the protective cover mounted thereon.
Figure 6:
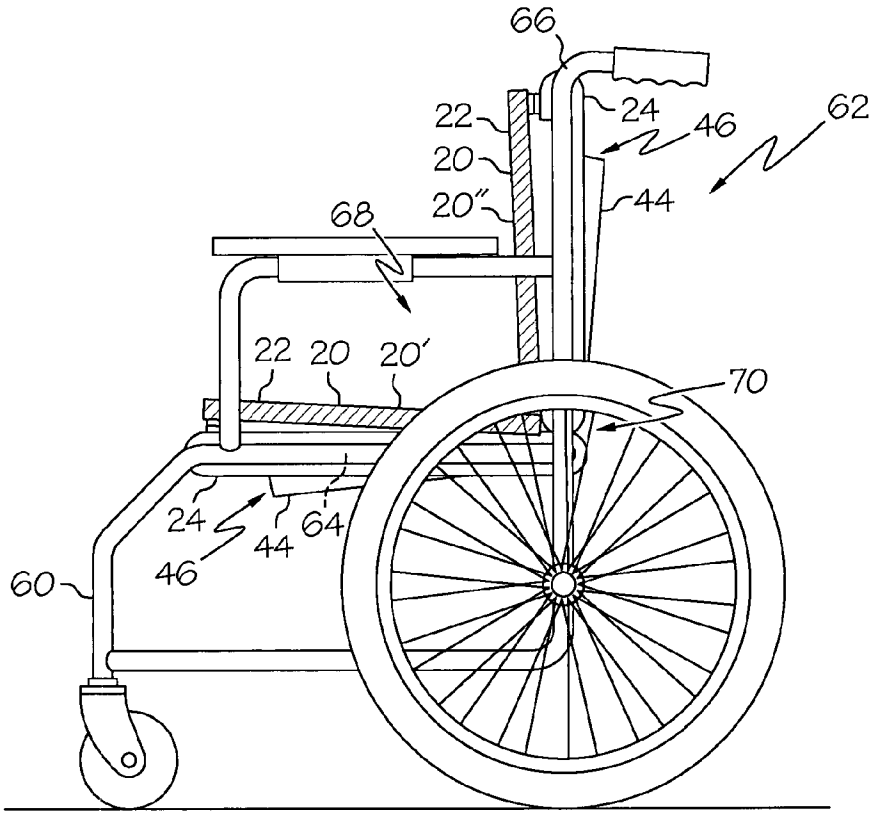
FIG. 6 shows a side view of a wheelchair having a protective cover system mounted thereon.

Referring to FIGS. 6-7, FIG. 6 shows a side view of a wheelchair 60 having a protective cover system 62 mounted thereon, and FIG. 7 shows a rear view of wheelchair 60 with protective cover 20 mounted thereon. Protective cover system 62 includes two protective covers 20. That is, a first protective cover 20' is utilized for placement about a seat 64 of wheelchair 60, and a second protective cover 20" is utilized for placement about a back 66 of wheelchair 60.

As mentioned before, separate protective covers 20 are utilized to cover seat 64 and back 66 of wheelchair 60. Separate protective covers 20 are individually installed and removed from either seat 64 or back 66 so that if only one is soiled, that one protective cover 20 may be cleaned. Furthermore, in keeping with the desire to create an individual look, a wheelchair occupant may wish to mix various colors, patterns, and/or textures of protective covers 20. Thus, a wheelchair occupant may select different styles of protective covers 20 for each of seat 64 and back 66.

Regarding seat 64, first cover section 22 of first protective cover 20' is configured to reside on a user-facing side 68 of wheelchair 60. First protective cover 20' is wrapped around a rear edge of seat 64 so that second cover section 24 resides below seat 64. Flap portion 40 (FIG. 5) is subsequently wrapped around the front edge of seat 64 so that second coupler 42 (FIG. 5) engages with first coupler 38 (FIG. 5). As such, opening 46 of storage pocket 44 faces in a forward direction relative to wheelchair 60 so that storage pocket 44 is readily accessible by the wheelchair occupant.

Similarly, first cover section 22 of second protective cover 20" is configured to reside on user-facing side 68 of wheelchair 60. Second protective cover 20" is wrapped around a bottom edge of back 66 so that second cover section 24 resides on the side of back 66 opposing user-facing side 68. Flap 40 is subsequently wrapped over the top edge of back 66 so that second coupler 42 engages with first coupler 38. As such, storage pocket 44 faces in an upward direction relative to wheelchair 60. Storage pocket 44 may then be accessed by the wheelchair occupant and/or the occupant's assistant.

In a typical wheelchair, such as wheelchair 60, seat 64 and back 66 are individual units. Thus, a gap 70 is present at the rear edge of wheelchair 60. The design of protective cover 20 capitalizes on the presence of gap 70 by enabling protective cover 20 to be routed through gap 70 to wrap around and form the closed loop around either seat 64 or back 66. In such a manner, protective cover 20 effectively protects seat 64 or back 66, is held securely in place against seat 64 or back 66, and forms an aesthetically satisfactory enclosure about seat 64 or back 66.

In summary, the present invention teaches of a protective cover for a chair, such as a wheelchair. The simple, generally rectangular, design with mating fasteners located at each extreme edge of the protective cover provides a simply installed and economical way to maintain clean and sanitary conditions for a wheelchair occupant. In addition, the simple generally rectangular design enables inexpensive manufacturing processes. Cost savings, in the form of lower manufacturing costs, can be passed to consumers so that the consumers are more likely to own multiple protective covers. Furthermore, the present invention utilizes separate protective covers for each of the back and seat of the chair. These separate protective covers may be individually installed and removed for easy replacement when one of the covers is soiled and/or when a wheelchair occupant wishes to mix and match different patterns, colors, and/or textures of protective covers to reflect the wheelchair occupant's aesthetic needs and desires.

Although the preferred embodiments of the invention have been illustrated and described in detail, it will be readily apparent to those skilled in the art that various modifications may be made therein without departing from the spirit of the invention or from the scope of the appended claims. For example, other fastener styles, materials, and the like may be selected other than that which are shown or described.

What is claimed is:

1. A cover for a chair comprising:

a first cover section having a first edge and a second edge opposing said first edge;

a second cover section having a third edge and a fourth edge opposing said third edge, said third edge being conjoined with said second edge, and said second cover section including a flap portion along said fourth edge; and means for detachably coupling said second cover section proximate said fourth edge with said first cover section proximate said first edge to form a closed loop, said first and second cover sections forming a contiguous unit having a first surface and a second surface, said first surface defining an interior of said closed loop, and said coupling means includes a first coupler positioned on said first surface of said first cover section and a second coupler positioned on said second surface of said second cover section along said flap portion, said flap portion being folded to enable coupling of said second coupler with said first coupler.

2. The cover as claimed in claim 1 wherein said first cover section is configured for placement on a user-facing side of one of a seat and a back of said chair, and said cover further comprises a cushion coupled with said first cover section.

3. The cover as claimed in claim 2 wherein said cushion is selectively removable from said first cover section.

4. The cover as claimed in claim 1 wherein said first cover section includes an interior cavity for accommodating placement of a cushion.

5. The cover as claimed in claim 1 wherein said second cover section is configured for placement on a side of one of a seat and a back of said chair opposite from a user-facing side of said chair, and said cover further comprises a storage pocket coupled to said second cover section.

6. The cover as claimed in claim 5 wherein an opening of said storage pocket faces said fourth edge of said second cover section.

7. The cover as claimed in claim 5 further comprising closure means for closing an opening into said storage pocket.

8. The cover as claimed in claim 1 wherein said coupling means includes hook and loop fasteners.

9. A protective cover for a wheelchair, said wheelchair including a seat and a back, and said protective cover comprising:

a first cover section having a first edge and a second edge opposing said first edge, said first cover section being configured to reside on a user-facing side of one of said seat and said back of said wheelchair;

a second cover section having a third edge and a fourth edge opposing said third edge, said third edge being conjoined with said second edge, said second cover section being configured to reside on a second side of said one of said seat and said back opposite from said user-facing side, and said second cover section including a flap portion along said fourth edge;

a storage pocket coupled to said second cover section; and means for detachably coupling said second cover section proximate said fourth edge with said first cover section proximate said first edge to form a closed loop around said one of said seat and said back, said first and second cover sections forming a contiguous unit having a first surface and a second surface, said first surface defining an interior of said closed loop, and said coupling means including a first coupler positioned on said first surface of said first cover section and a second coupler positioned on said second surface of said second cover section along said flap portion, said flap portion being folded to enable coupling of said second coupler with said first coupler.

10. The protective cover as claimed in claim 9 further comprising closure means for closing an opening into said storage pocket.

11. The protective cover as claimed in claim 9 further comprising a selectively removable cushion coupled with said first cover section.

12. A protective cover system for a wheelchair, said wheelchair including a seat and a back, and said protective cover system comprising:

a first cover for placement about said seat of said wheelchair; and a second cover for placement about said back of said wheelchair, each of said first and second covers including:

a first cover section having a first edge and a second edge opposing said first edge, said first cover section being configured to reside on a user-facing side of a respective one of said seat and said back;

a second cover section having a third edge and a fourth edge opposing said third edge, said third edge being conjoined with said second edge, said second cover section being configured to reside on a side of said respective one of said seat and said back opposite from said user-facing side, and said second cover section including a flap portion along said fourth edge;

means for detachably coupling said second cover section proximate said fourth edge with said first cover section proximate said first edge to form a closed loop around said respective one of said seat and said back, and said coupling means including a first coupler positioned on said first surface of said first cover section and a second coupler positioned on said second surface of said second cover section along said flap portion, said flap portion being folded to enable coupling of said second coupler with said first coupler.

13. The protective cover system as claimed in claim 12 wherein said first cover section comprises an interior cavity for accommodating placement of a cushion.

14. The protective cover system as claimed in claim 12 wherein said first cover further comprises a storage pocket coupled to said second cover section, said storage pocket having an opening configured to face a forward direction relative to said wheelchair.

15. The protective cover system as claimed in claim 12 wherein said second cover further comprises a storage pocket coupled to said second cover section.

* * * * *